United States Patent [19]

Anderson

[11] 4,271,993

[45] Jun. 9, 1981

[54] SLAG TAP FOR COAL SLAGGING GASIFIER

[75] Inventor: John A. Anderson, Knowle, England

[73] Assignee: British Gas Corporation, London, England

[21] Appl. No.: 8

[22] Filed: Jan. 2, 1979

Related U.S. Application Data

[60] Continuation of Ser. No. 830,497, Sep. 6, 1977, abandoned, which is a division of Ser. No. 744,026, Nov. 22, 1976, abandoned.

[30] Foreign Application Priority Data

Nov. 27, 1975 [GB] United Kingdom ..... 48806/75

[51] Int. Cl.[3] ..... B22D 41/08; B01J 3/00

[52] U.S. Cl. ..... 222/591; 222/592; 266/191

[58] Field of Search ..... 164/98; 266/270, 271, 266/191; 222/591, 592, 597; 165/142

[56] References Cited

U.S. PATENT DOCUMENTS

| | | | |
|---|---|---|---|
| 2,190,296 | 2/1940 | Richardson | 222/591 X |
| 2,476,889 | 7/1949 | Mohr, Jr. et al. | 266/191 |
| 3,028,874 | 4/1962 | Burkett | 222/597 X |
| 3,674,248 | 7/1972 | Shellenberger | 266/270 |
| 3,853,309 | 12/1974 | Widmer | 266/270 |

*Primary Examiner*—David A. Scherbel
*Attorney, Agent, or Firm*—Larson and Taylor

[57] ABSTRACT

An improved slag outlet for a slagging gasifier, comprises a cast body of high thermal conductivity having integral coolant passageways, said passageways being formed by shaping a metal tube into a coil having an inlet and an outlet, and casting metal to the desired shape around the coil such that the inlet and outlet communicate exteriorly of the cast body.

6 Claims, 3 Drawing Figures

SLAG TAP FOR COAL SLAGGING GASIFIER

Figure 1:
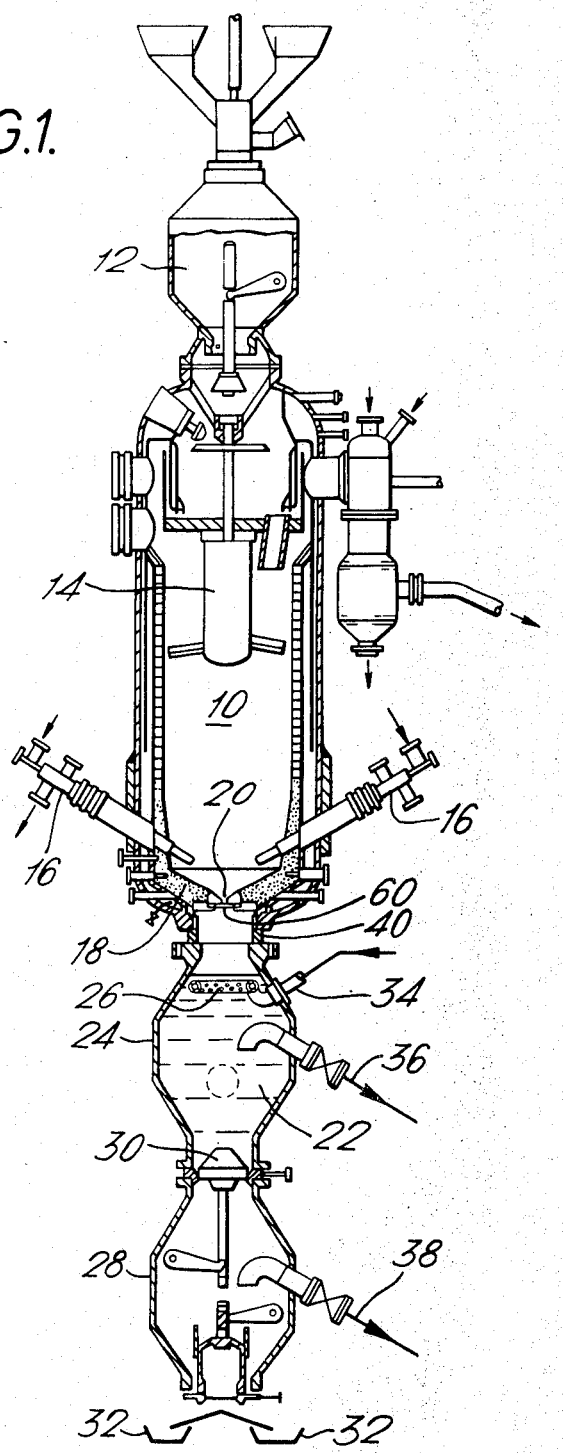

This is a continuation, of application Ser. No. 830,497 filed Sept. 6, 1977, now abandoned, which was a division of application Ser. No. 744,026, filed Nov. 22, 1976, now abandoned.

This invention relates to coal gasification plant, and more particularly to a slag outlet for use in slagging gasifier plants of the kind (hereinafter referred to as the kind specified) in which coal, or other carbonaceous fuel, is introduced into the top of a column-like gasifying vessel and is gasified under high pressure and temperature by means of oxygen and steam introduced near the fuel bed through tuyeres. The residual ash collects as a molten slag and iron in the hearth of the gasifier vessel from which it is periodically discharged (commonly known as slag-tapping) downwardly through a slag tap outlet or orifice in the hearth into water contained in a quenching chamber. Usually, a pool of molten slag and iron is maintained in the hearth by directing hot combustion products from a burner located beneath the slag tap orifice up the tap orifice to retain the pool of slag and iron in the hearth, the tapping of the molten slag and iron being initiated and controlled by stopping or reducing the burner output and reducing the pressure in the quenching chamber by controlled venting to atmosphere through its venting system so as to produce a differential pressure between the quenching chamber and the gasifier vessel.

Examples of such slagging gasifier plant are these disclosed in U.K. Patent Specification No. 977,122, The Gas Council Research Communications No's GC 50 and GC 112.

The containment materials of the slag tap and hearth in such slagging gasifiers are subject to aggressive erosion, corrosion and thermal attack by the slag and iron. The high temperature and mobility of the slag and iron during slag tapping and slag retention make the containment materials of the slag tap orifice and its immediate vicinity primarily subject to erosion and thermal attack by the iron. Difficulties have been experienced in providing a slag outlet for such a gasifier which does not rapidly deteriorate under the high temperature conditions and the iron present in the slag during operation of the gasifier, and an object of the present invention is to provide an improved slag tap member and a method of forming an improved slag tap member for a slagging gasifier, less subject to these disadvantages.

According to one aspect of the present invention, there is provided a slag tap for use in a coal slagging gasifier comprising a solid cast mass of high thermal conductivity metal having an integrally formed metal tube for circulating a coolant liquid through the cast mass, and having an upper tundish surface across which slag discharged from the gasifier flows and a central slag removal orifice, the upper surface sloping downwardly and inwardly and merging with the slag removal orifice, the coolant tube being capable of retaining its shape without any appreciable distortion during the casting of the surrounding metal mass, the tube extending through the cast mass and forming a coolant conduit adjacent to the tundish surface and the surface of the orifice passageway and spaced from the surfaces a distance of 0.25 to 1.5 inches, the ends of the tube projecting exteriorly of the surrounding cast metal mass to provide a coolant inlet and outlet.

In another aspect of the invention, the slag tap is manufactured by providing a metal tube coil having an inlet and an outlet and being capable of retaining its shape without any appreciable distortion during the casting of a surrounding metal mass. A mass of high thermal conductivity is cast around the coil to a desired shape such that the inlet and outlet project exteriorly of the surrounding cast mass. The cast mass is formed with a downwardly and inwardly sloping uppermost tundish surface which merges with a peripheral surface of a central, substantially vertical, slag removal orifice passageway. The coiled tube has convolutions arranged to extend adjacent to the uppermost surface of the slag tap and to the peripheral surface of the central orifice passageway. The convolutions are spaced a distance of 0.25 to 1.5 inches from these surfaces.

The concept of controlling the rate of slag flow from the hearth reservoir through the slag tap orifice, and the resistance to erosion of the slag tap itself, depends on critical factors of design of the slag tap involving, among things, the thermal conductivity of the material used, the shape and geometry of its metal mass, the size of its orifice, and the size, length and location of its coolant passageway with respect to the surfaces of the slag tap exposed to thermal attack.

The amount and rate of flow of coolant liquid is also an important factor in the slag tap design since the exposed surfaces must be cooled efficiently to maintain acceptable surface temperatures, but on the other hand it is important that excessive quantities of heat are not removed from the hearth by the slag tap. Typically, flow velocities of the order of 20–30 ft/sec are preferred to give a constant passageway wall temperature with the range 10° C. to 20° C.

Preferably, the slag tap member is formed of copper or copper and alloyed metal.

Preferably also, the coolant passageway is of spiral form, the convolutions thereof extending at least around and near to the exposed surfaces of the slag tap member.

Conveniently, the coolant passageway may be provided by a metal tube of spirally coiled form, the ends of which project exteriorly of the surrounding metal mass to provide said inlet and outlet.

The uppermost surface of the slag tap (generally known as the tundish region) preferably slopes downwardly and inwardly and merges with the peripheral surface of the central orifice which may be of right-circular cylindrical form. The surface of revolution of the tundish may be of any suitable cross-sectional profile, for example, part-circular or parabolic, although preferably it is of frusto-conical form.

In a typical operating condition of the gasifier, in which the temperature of the slag pool is of the order of 1450° C. and that of the burner gases about 1500°–1600° C., the uppermost surface or tundish of the slag tap is maintained at a temperature within the range of 200° C. to 400° C., the cylindrical surface of its orifice is maintained at a temperature within the range 100° C. to 400° C., and the lowermost surface of the slag tap adjacent the burner is maintained at a temperature within the range 50° C. to 400° C.

Preferably, the coiled tube is of a metal capable of retaining its shape without any appreciable distortion during the casting process in addition to providing good thermal contact with the casting metal.

For example, the tube may be formed of nickel-chrome or nickel-chrome and alloyed metals which also have a high resistance to corrosion.

Furthermore, the external surface of the tube may be provided with means for improving the bonding with the casting metal and to reduce any tendency to stress fractures of the casting metal upon cooling after casting especially where different metals are used for the tube and casting metal.

Figure 2:
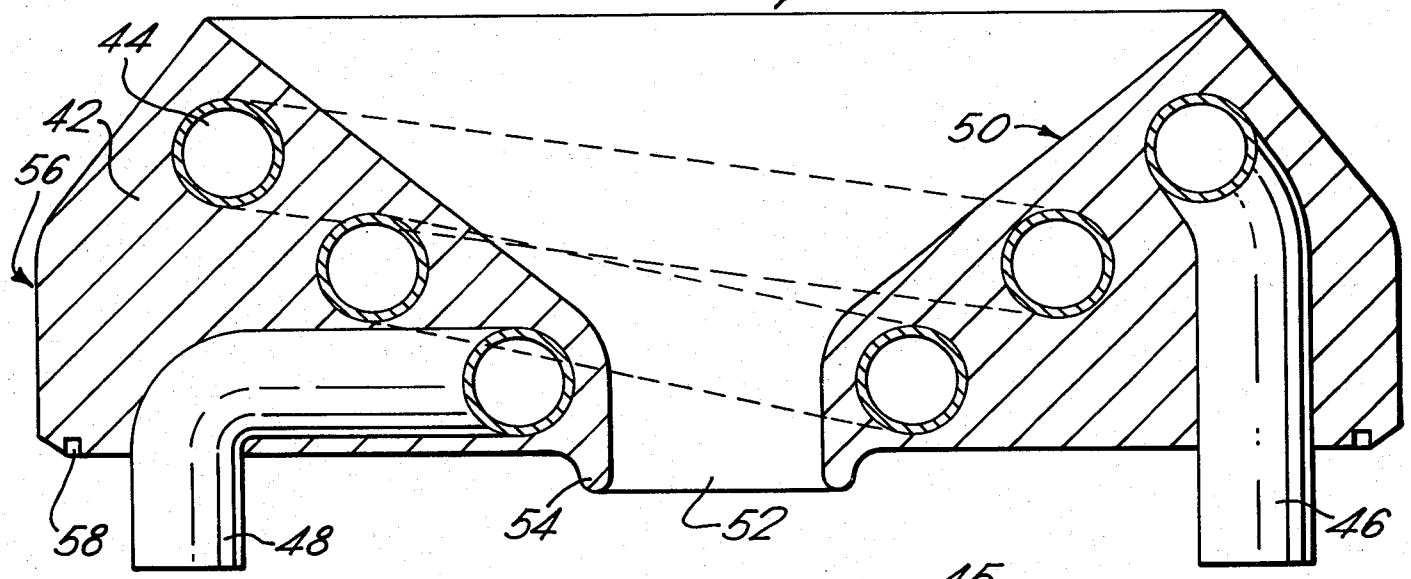
Figure 3:
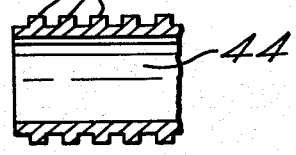

An embodiment of aspects of the invention will now be described with reference to the accompanying drawings in which:

FIG. 1 is a diagrammatic longitudinal sectional elevation of a fixed but slagging gasifier, FIG. 2 is a sectional elevation of the removable slag tap member of the gasifier shown in FIG. 1, and FIG. 3 is a fragmentary sectional elevation of the coiled tube in the slag tap member.

Referring first to FIG. 1, the gasifier has a refractory-lined pressurised gasification chamber 10 into which coal is fed from a lock hopper 12 and distributed by rotatable distributor means 14. Oxygen and steam are introduced into the fuel bed (not shown) through tuyeres 16 to promote gasification of the coal. In use of the gasifier, a reservoir or pool of molten slag and iron collects on the sloping hearth 10 and is periodically passed, through an orifice formed in a removable slag tap 20 supported within the hearth, into a water reservoir 22 contained in a quenching chamber 24 where it is rapidly quenched in a region of turbulent water issuing from a perforated tubular ring 26 before being transferred to a lock hopper 28 in the form of a dense small-grained frit entrained with some of the quenching water upon operation of a valve 30. The frit is discharged from the lock hopper 28 onto moving conveyors 32. Water supplied to the quench ring 26 through an inlet 34 may partly be water recirculated through outlets 36, 38 from the quenching chamber and slag lock hopper 24, 23 respectively by pump and filter means (not shown).

The quenching chamber 24 is secured in a gas tight manner to the bottom of the gasifier chamber 10 through the intermediary of a sandwich flange assembly 40. A nozzle-mixing burner 60 together with the slag tap 20 is supported by the annular flange assembly 40, but is arranged to be readily removable therefrom.

Referring now to FIG. 2, the slag tap 20 comprises a body 42 of copper or copper and alloyed metal cast around a spirally coiled pipe 44 having an inlet 46 and an outlet 48, for the circulation of coolant water, projecting from the base of the body. A tundish surface 50 of the slag tap is of frusto-conical form and merges with the cylindrical surface of a slag discharge orifice 52 which terminates in an annular lip 54. The outer peripheral surface 56 of the body 42 is preferably tapered so as to facilitate easy removal from the hearth of the gasifier. An annular recess 58 is provided in the base of the body 42 for co-axial engagement with an annular projection (not shown) on the sandwich flange assembly.

In a specific example of a slag tap, the coiled pipe 44 was formed of nickel-chrome alloy, for example Inconel 600, about 42 inches in length, with an inside diameter of 0.5 inch and wall thickness of 0.125 inch. The overall width of the cast body 42 was about 12.75 inches with an overall height of about 4.5 inches. The diameter of the orifice 52 was 2 inches, and 1.5 inches in height, merging into the tunlish surface which is at an angle of 38° to the horizontal. Preferably, the outer surface of the cast-in length of the coiled pipe is formed with a plurality of spaced annular ribs 45 (See FIG. 3) for improving the bond with the casting metal which enhances heat transmission to the coolant liquid, and to obviate any tendency to fracture of the casting upon cooling after the casting process. The coiled pipe is located within the cast body so that the convolutions thereof extend at least around and adjacent the surfaces of the tundish and orifice, and preferably, these convolutions which are adjacent said surfaces are spaced therefrom to between 0.25 inch and 1.5 inches. The slag tap is made by first forming the pipe 44 into the desired spirally coiled form, supporting the pipe by suitable means in a suitable mould from which the inlet 46 and outlet 48 protrude, and casting copper or copper alloy in the mould to form the body 42. This method of manufacture gives a good contact and thus heat transmission between the body 42 and the coolant conduit formed by the pipe 44.

I claim:

1. A slag tap for use in a coal slagging gasifier comprising:

a body comprised of a solid cast mass of high thermal conductivity metal;

said body having a central, right-circular cylindrical orifice through the bottom thereof, said orifice being oriented substantially vertically when said tap is in its normal operating position in a coal slagging gasifier, a downwardly and inwardly sloping tundish surface extending from the top of said body and converging on and merging smoothly with the surface forming said orifice such that said tundish surface is upwardly positioned substantially horizontally above said orifice and forms a funnel when said slag tap is in its normal operating position in a coal slagging gasifier, and the slope and length of said tundish surface and the diameter and length of said orifice being selected such that the overall width of said body is at least twice the overall height thereof and the height of said orifice is less than half the overall height of said body so that slag that is to be discharged from the gasifier can readily flow across said tundish surface and be removed through said orifice; and an integrally formed, spirally coiled metal tube for circulating a coolant liquid through said cast body, said coolant tube being capable of retaining its shape without any appreciable distortion during the casting of the surrounding metal mass and said coolant tube extending through said cast mass and forming a spiral coolant conduit adjacent to the top of said body and closely spaced from said tundish surface along the length thereof and closely spaced from and coiled around said orifice surface, said spacing from said surfaces being a distance of from 0.25 to 1.5 inches, the ends of said tube projecting exteriorly of the bottom of the surrounding cast metal body to provide a coolant inlet and outlet, the spiral of said tube approximating the surface of said tundish surface and said orifice surface.

2. A slag tap according to claim 1 wherein said cast metal mass comprises copper or copper and alloyed metal.

3. A slag tap according to claim 1 wherein the upper tundish surface of the slag tap is of frusto-conical form.

4. A slag tap according to claim 1 wherein the outer peripheral surface of the slag tap is tapered.

5. A slag tap according to claim 1 wherein the outer surface of the metal tube is formed with a plurality of spaced annular ribs for improving the bond with the surrounding cast metal.

6. A slag tap as claimed in claim 1 wherein the slope of said tundish surface is about 38°.

* * * * *